US011800907B2

(12) United States Patent
McDonald et al.

(10) Patent No.: US 11,800,907 B2
(45) Date of Patent: Oct. 31, 2023

(54) HEADWEAR WITH IMPROVED TEMPLE OPENINGS

(71) Applicants: John McDonald, Garden Grove, CA (US); Cynthia McDonald, Garden Grove, CA (US)

(72) Inventors: John McDonald, Garden Grove, CA (US); Cynthia McDonald, Garden Grove, CA (US)

( * ) Notice: Subject to any disclaimer, the term of this patent is extended or adjusted under 35 U.S.C. 154(b) by 246 days.

(21) Appl. No.: 17/412,172

(22) Filed: Aug. 25, 2021

(65) Prior Publication Data

US 2022/0346483 A1 Nov. 3, 2022

Related U.S. Application Data

(60) Provisional application No. 63/182,932, filed on May 1, 2021.

(51) Int. Cl.
*A42B 1/247* (2021.01)
*A42B 1/241* (2021.01)
*A42B 1/041* (2021.01)

(52) U.S. Cl.
CPC ..... *A42B 1/247* (2013.01); *A42B 1/041* (2013.01); *A42B 1/241* (2013.01)

(58) Field of Classification Search
CPC ..... A42B 1/247; A42B 1/242; A42B 1/041; A41D 27/204; A41D 20/00
See application file for complete search history.

(56) References Cited

U.S. PATENT DOCUMENTS 2,598,638 A * 5/1952 Enos ..... D05B 35/02 112/423
3,105,973 A * 10/1963 Stiefelmeier ..... D05B 3/10 2/912
3,664,335 A * 5/1972 Boucher ..... A41D 13/113 128/206.19
4,349,920 A * 9/1982 Off ..... A41D 27/20 2/247
4,607,633 A * 8/1986 Lauritzen ..... A61F 13/0203 156/250
6,671,885 B2 * 1/2004 Viggiano ..... G02C 3/02 2/209.13
10,143,254 B2 12/2018 Hawes et al.
2014/0033397 A1 * 2/2014 Schwantes ..... A41D 20/00 2/209.13

(Continued)

*Primary Examiner* — Jillian K Pierorazio
(74) *Attorney, Agent, or Firm* — Aaron P. McGushion

(57) ABSTRACT

The present specification discloses headwear configured to permit the user to easily don an item of eyewear, such as prescription glasses, reading glasses, sun glasses, safety glasses, and the like. The present headwear provides a unique pocket design on each side with an eyewear temple aperture located within the pockets. The pockets are created by forming a z-folded configuration out of a fabric panel for each pocket and tacking the three layers of material together, above and below the eyewear temple aperture. Each of the pockets are positioned forward of at least part of the ears, and open towards the user's anterior. The outermost panel of each of the pockets protrudes from the sides of the headwear to provide sufficient clearance for the temples of the eyewear to easily slip into the pockets and through the eyewear temple apertures.

18 Claims, 3 Drawing Sheets

(56) References Cited

U.S. PATENT DOCUMENTS

| | | | | |
|---|---|---|---|---|
| 2015/0366283 | A1* | 12/2015 | Poldoski | A42B 1/247 2/171 |
| 2016/0021962 | A1* | 1/2016 | Lacy | A42B 1/22 2/181 |
| 2019/0075875 | A1* | 3/2019 | Lacy | A42B 1/22 |
| 2021/0259346 | A1* | 8/2021 | Hodgdon | A42B 1/22 |

* cited by examiner

HEADWEAR WITH IMPROVED TEMPLE OPENINGS

This patent application claims the benefit of U.S. Provisional Patent Application Ser. No. 63/182,932, entitled "Headwear With Improved Temple Openings," filed May 1, 2021, which application is incorporated in its entirety here by this reference.

BACKGROUND

The subject of this patent application relates generally to headwear configured to be used in conjunction with various eyewear temples.

By way of background, when wearing headwear, the headwear often interferes with the fit and comfort of the eyewear (e.g., eyeglasses, sunglasses, safety glasses, etc.). Further, it is difficult with current headwear having slots for eyewear temples to quickly insert both temples simultaneously into the slots due to slots being set close to the head. The user must feel with their hands and open the slots one at a time. What is needed is headwear adapted for use with eyewear that permits the wearer to easily don the eyewear and comfortably and effectively wear both simultaneously.

Aspects of the present invention fulfill these needs and provide further related advantages as described in the following summary.

SUMMARY

Aspects of the present invention teach certain benefits in construction and use which give rise to the exemplary advantages described below.

The present specification discloses an article of headwear comprising a fabric panel having an inner surface and an outer surface opposite the inner surface, the inner surface configured to face a head of a user, a right ear portion of the fabric panel configured to be disposed at least partially over a right ear of the user, a left ear portion of the fabric panel configured to be disposed over a left ear of the user, and a forehead portion configured to be disposed over a forehead of the user; a right folded portion formed in the fabric panel between the right ear portion and the forehead portion, the right folded portion forming a right pocket having a right pocket opening configured to open towards the forehead portion; a left folded portion formed in the fabric panel between the left ear portion and the forehead portion, the left folded portion forming a left pocket having a left pocket opening configured to open towards the forehead portion; a right aperture formed through the fabric panel within the right pocket of the right folded portion; and a left aperture formed through the fabric panel within the left pocket of the right folded portion; wherein, when donned, the right pocket opening and the left pocket opening are each configured to open in a substantially anterior direction, and the right pocket is configured to receive therein and the right aperture configured to receive therethrough a right temple of an item of eyewear, and the left pocket is configured to receive therein and the left aperture configured to receive therethrough a left temple of the item of eyewear.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present aeration container. In such drawings.

The above-described drawing figures illustrate aspects of the present aeration container in at least one of its exemplary embodiments, which are further defined in detail in the following description. Features, elements, and aspects of the aeration container and components that are referenced by the same numerals in different figures represent the same, equivalent, or similar features, elements, or aspects, in accordance with one or more embodiments.

DETAILED DESCRIPTION

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

The present specification discloses an article of headwear configured to permit the user to easily don an item of eyewear, such as prescription glasses, reading glasses, sun glasses, safety glasses, and the like. The present headwear provides a unique pocket design on each side with an eyewear temple aperture located within the pockets. The pockets are created by forming a z-folded configuration out of a fabric panel for each pocket and tacking the three layers of material together, above and below the eyewear temple aperture. In one or more embodiments, each of the pockets are positioned forward of at least part of the ears, and open towards the user's anterior. The outermost panel of each of the pockets protrudes from the sides of the headwear to provide sufficient clearance for the temples of the eyewear to easily slip into the pockets and through the eyewear temple apertures.

Figure 2:
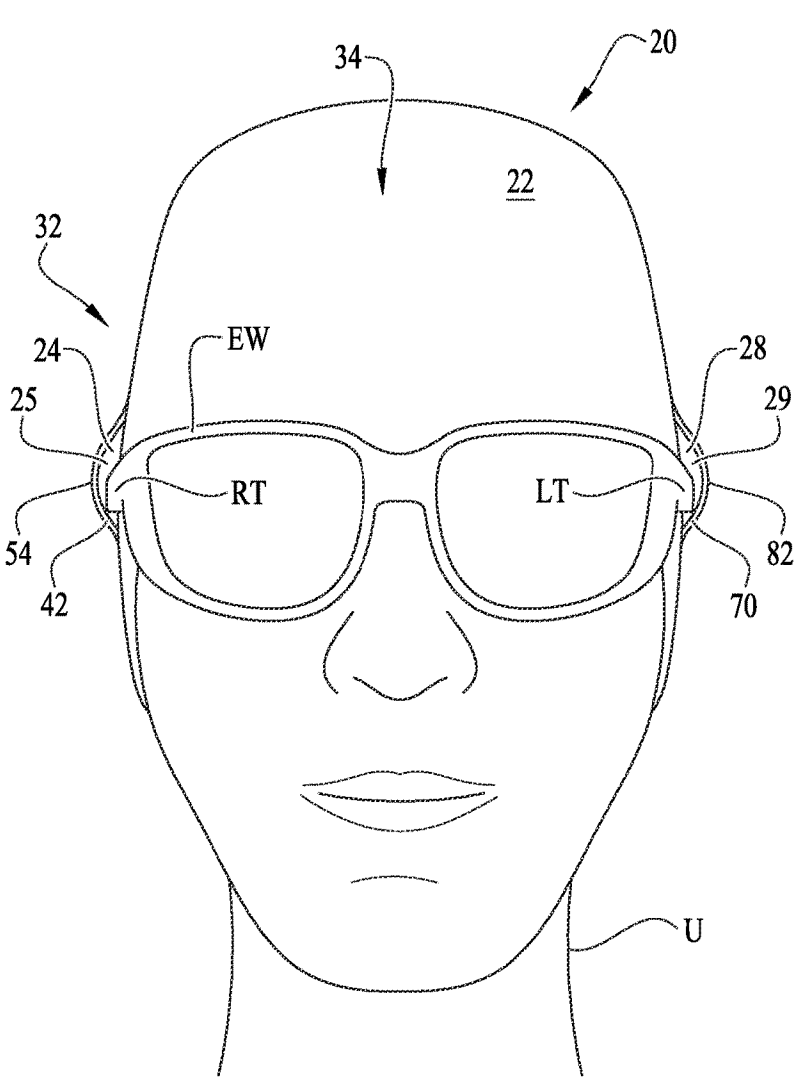
FIG. 2 is a front view of the headwear of FIG. 1.
Figure 1:
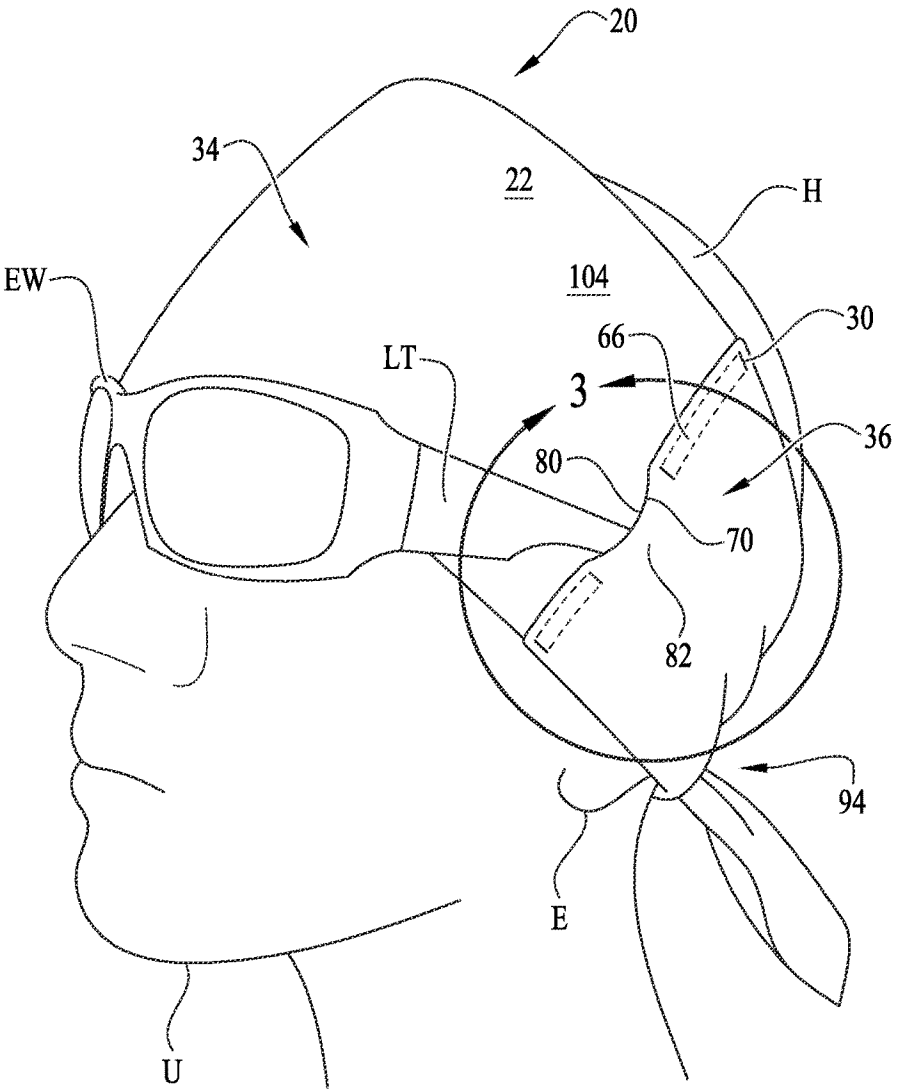
FIG. 1 is a perspective view of the present headwear donned by a user, in accordance with at least one embodiment disclosed herein.
Figure 4:
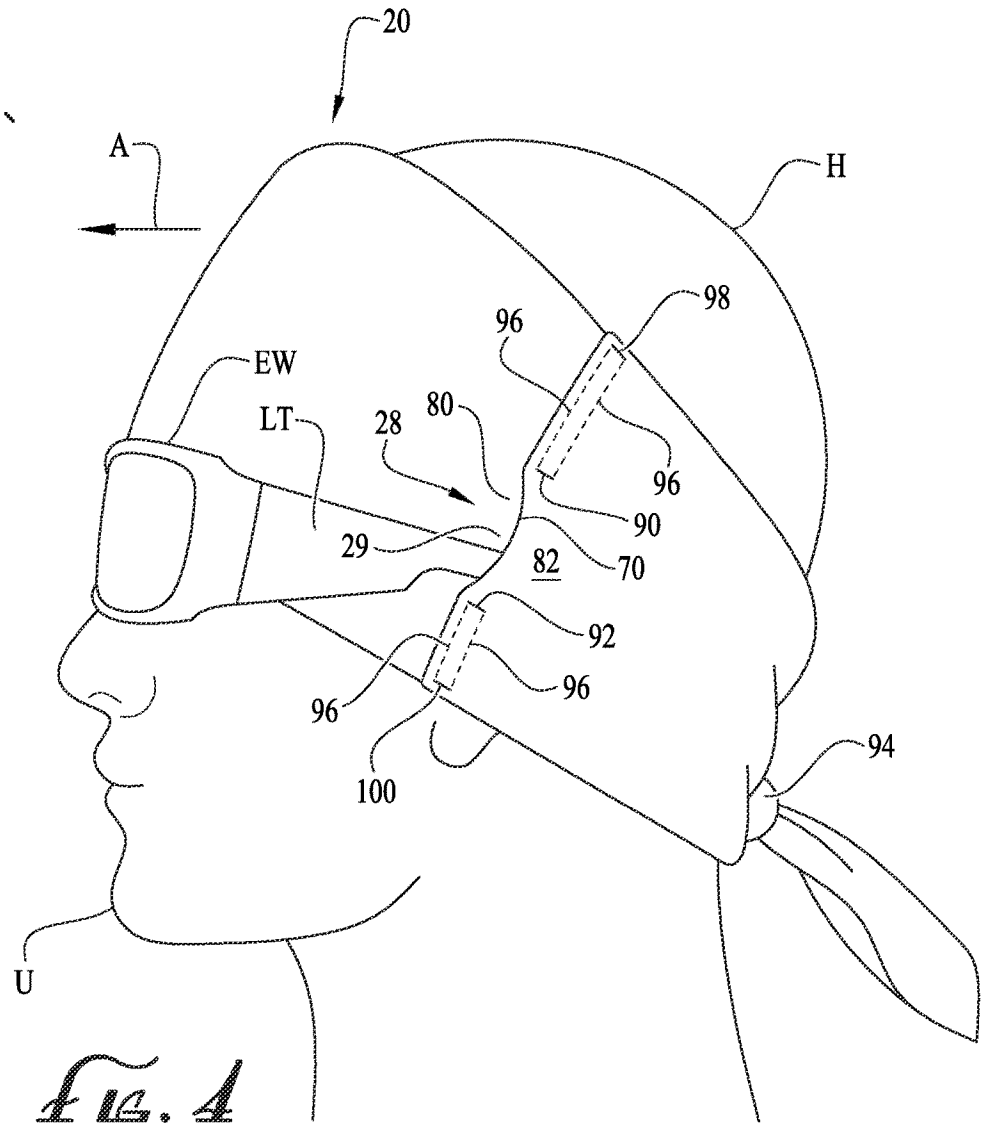
FIG. 4 is a side view of the headwear of FIG. 1.
Figure 3:
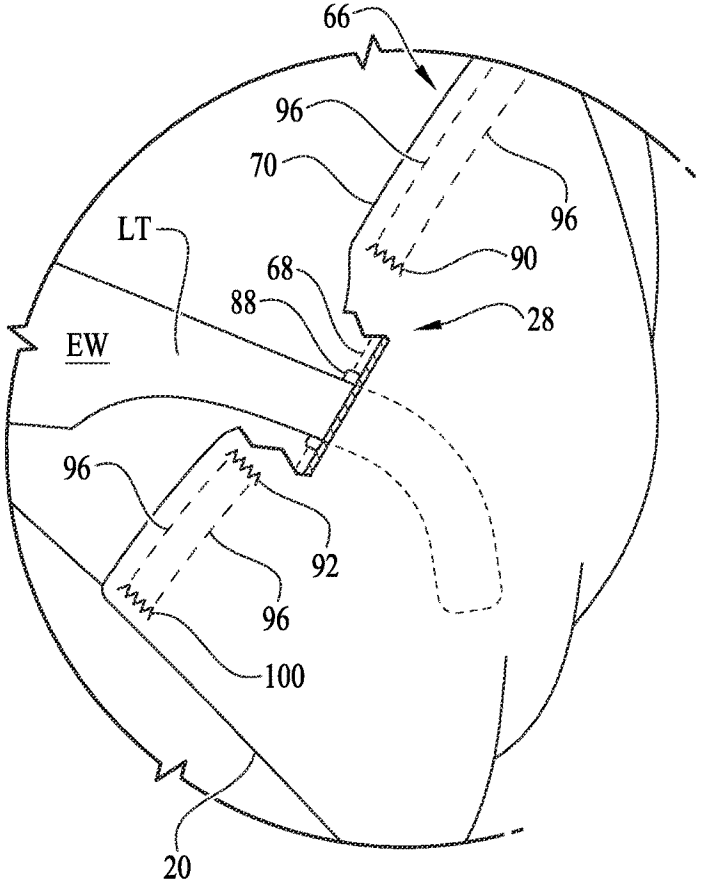
FIG. 3 is a magnified partial cross-sectional view of the headwear of FIG. 1.
Figure 5:
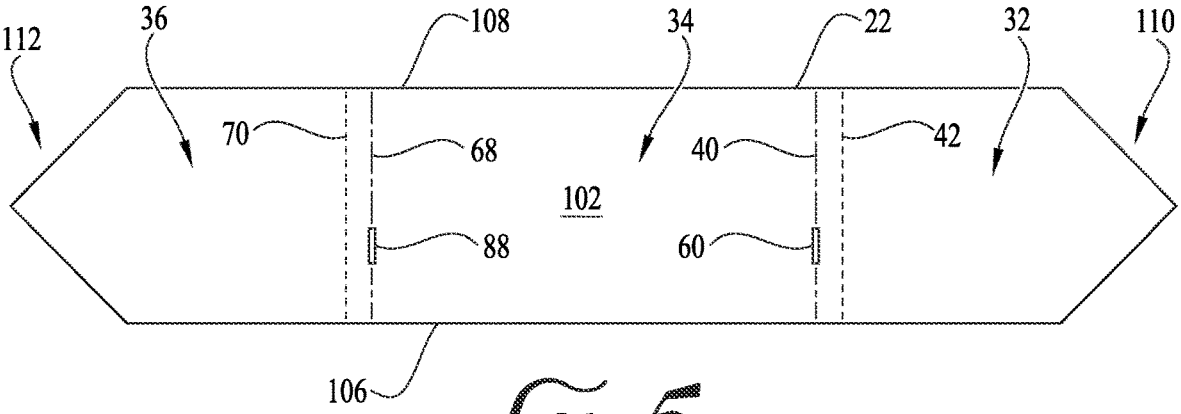
FIG. 5 is top view of the present headwear, illustrating a pattern and manufacturing process.
Figure 6:
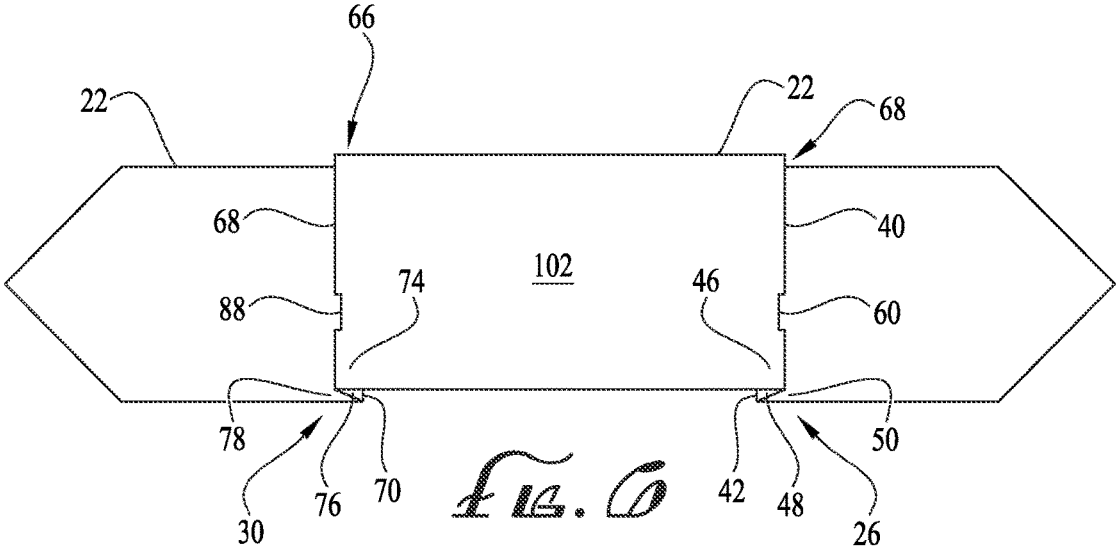
FIG. 6 is a top view of the headwear pattern and process of FIG. 5.
Figure 7:
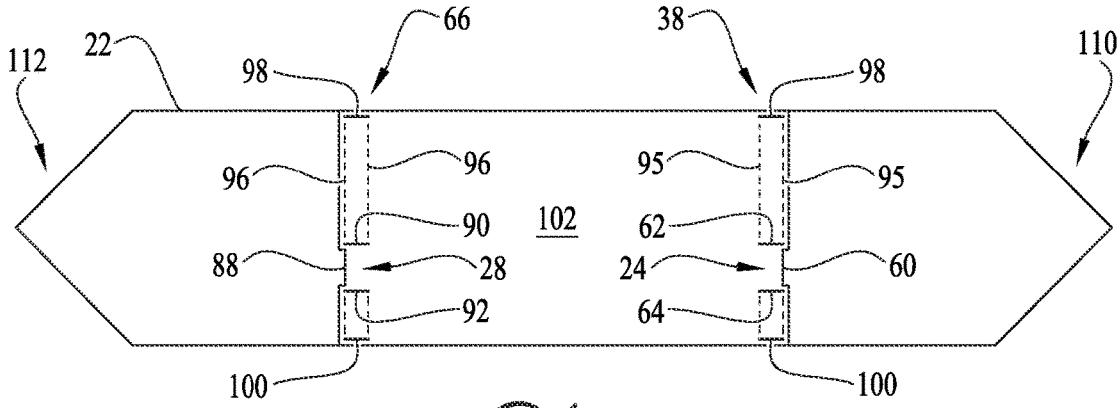
FIG. 7 is a top view of the headwear pattern and process of FIG. 5.

Referring first to FIGS. 1-4 (and also referring to FIGS. 5-7), an example embodiment of the present article of headwear 20 (which can be referred to herein as headwear) is illustrated donned on a user's U head H. In one or more embodiments, the preset headwear 20 includes a fabric panel 22 having an inner surface 102 opposite an outer surface 104, where the inner surface 102 is configured face the user's U head H, and, in at least some configurations, contacting the head H. The fabric panel 22 includes a right Z-fold 26 and a left Z-fold 30, each being positioned forward of the right ear portion right ear portion 32 and the left ear portion 36 (e.g., in one or more embodiments, the ear portions 32 and 36 are those portions of the fabric panel 22 which are configured to be in close proximity of the average user's U ears E and/or are covering at least a portion of the ears E), respectively, and folded transversely to the bottom edge 106 and the top edge 108 (i.e., the folds actually intersect the bottom edge 106 and the top edge 108, or would intersect these edges 106 and 108 if the fold lines were projected for folds that partially traverse the fabric panel 22). The Z-folds 26 and 30 are each folded and the resulting three layers are coupled (e.g., sewed or otherwise attached together) in a stacked arrangement to one another, with the right Z-fold 26 at least partially defining a right pocket 24 and the left Z-fold 30 at least partially defining a left pocket 28, each pocket 24 and 28 opening toward the forehead portion 34 of the fabric panel 22. The right Z-fold 26 results in a right three-layer arrangement 38; and the left Z-fold 30 results in a left three-layer arrangement 66.

The right three-layer arrangement 38 includes a right first layer 46, a right second layer 48, and a right third layer 50 created with a first right fold 40 and second right fold 42, folded oppositely to the first right fold 40. Looking at FIGS. 5-7, when viewing the fabric panel 22 from the inner surface 102 (i.e., the surface configured to face towards the user's head and opposite the outer surface 104), the fold lines illustrate that the first right fold 40 is a so-called mountain fold (dash-dot line) and the second right fold 42 is oppositely a so-called valley fold (dashed line), creating the right Z-fold 26. Similarly, the left three-layer arrangement 66 includes a left first layer 74, a left second layer 76, and a left third layer 78 created with a first left fold 68 and second left fold 70, folded oppositely to the first left fold 68, creating the left Z-fold 30. Again, when viewing the fabric panel 22 from the inner surface 102, the fold lines illustrate that the first left fold 68 is a so-called mountain fold (dash-dot line) and the second left fold 70 is oppositely a so-called valley fold (dashed line).

The right temple aperture 60 is illustrated as being a slit through the fabric panel 22 oriented along the first right fold 40. The left temple aperture 88 is illustrated as being a slit through the fabric panel 22 oriented along the first left fold 68. In one or more example embodiments, the right temple aperture 60 and the left temple aperture 88, can be positioned to one side or the other of their respective fold lines 40 and 68. When positioned on the fold lines 40 and 68, the right temple aperture 60 and the left temple aperture 88 will ultimately be positioned at the bottom of the resulting right pocket 24 and left pocket 28, respectively, as the first right fold 40 and the first left fold 68 acts as the bottom of the pockets 24 and 28, respectively. In one or more embodiments, the raw edges of the right temple aperture 60 and the left temple aperture 88 are reinforced with stitching, such as the zig-zag stitching used for button holes. Although the right temple aperture 60 and the left temple aperture 88 are illustrated as slits, they can be circular or elongate holes, or any other appropriate shape holes.

Once the right Z-fold 26 is laid flat to form the right three-layer arrangement 38, the right first layer 46, the right second layer 48, and the right third layer 50 can be coupled together in a flat arrangement, such as by bonding and/or double stitching along the length of the overlap of the three layers, leaving the region of the right pocket 24 uncoupled (or unstitched) such that the right pocket 24 is formed along a portion of the right three-layer arrangement 38. The right upper joint 62 and the right lower joint 64 define the upper and lower bounds of the right pocket 24, generally using bar tacks.

Similarly, once the left Z-fold 30 is laid flat to form the left three-layer arrangement 66, the left first layer 74, the left second layer 76, and the left third layer 78 can be coupled together in a flat arrangement, such as by bonding and/or double stitching along the length of the overlap of the three layers, leaving the region of the left pocket 28 uncoupled (or unstitched) such that the left pocket 28 is formed along a portion of the left three-layer arrangement 66. The left upper joint 90 and the left lower joint 92 define the upper and lower bounds of the left pocket 28, generally using bar tacks. Further, on each side, a top joint 98 and a bottom joint 100 (such as bar tacks) terminate the right stitching 95 and the left stitching 96 just before the top edge 108 and the bottom edge 106 of the fabric panel 22.

Looking further at the left pocket 28 (which is similar in construction to the right pocket 24), once sewn, the left first layer 74 forms the left pocket inner panel 80, and the left second layer 76 laid flat with left third layer 78 form the left pocket outer panel 82. In one or more embodiments, when sewing the left stitching 96, the outer panel 82 can be bunched together slightly such that the outer panel 82 will separate and protrude from the inner panel 80 so that the left pocket opening 29 is made wider, so that the pocket openings 25 and 29 open towards the anterior A direction (i.e., forward facing). This gap or spacing between the inner panel 80 and the outer panel 82 can also be obtained, even when the inner panel 80 and the outer panel 82 are sewn in a flat arrangement (with no bunching), due to the gap between the panels 80 and 82 forming by the user U donning the headwear 20 on their head H because of the curvature of the head H. Further, the gap can be created by support structure sewn into or otherwise connected to the outer panel 82, such as a flexible plastic strip traversing the pocket openings 25 and 29 and biasing the outer panel 82 away from the inner panels 52 and 80, respectively.

In this way, on both sides, the right temple RT and the left temple LT will easily and simultaneously locate within their respective pockets. Additionally, since the right temple aperture 60 and the left temple aperture 88 are each located within their respective pockets 24 and 28 and at the very bottom of the pockets 24 and 28 (e.g., along the respective first folds 40 and 68), the inner panel 80 and the outer panel 82 tend to guide or funnel the right temple RT and the left temple LT towards and through the apertures 60 and 88.

In this example the headwear is a bandana headwear or headwrap, where the bandana can be folded into the elongated rectangular shape by folding in two opposing corners. However, many types of headwear are compatible with the present headwear 20 improvements, such as baseball caps, knit caps, scrub caps, head wraps, skull caps, and so on. Generally, these caps are designed to cover all or part of the head. In one or more headwear 20 embodiments, the headwear 20 optionally covers at least a portion of the user's U ear E. Here, the headwear 20 is configured as a headwrap made from a fabric panel 22, secured to the head H with a knot 94 on the back and leaving the crown of the head H uncovered. Other forms of fitting the headwear 20 to the head H can be used, such as a snap closure, a hook and loop closure, or the like. Also, the headwear 20 can be size to fit the head H.

Although the term fabric panel is used, the fabric panel 22 can be made of multiple pieces or panels of flexible sheet material connected together to form a panel, acting as the entire headwear 20 or part of a headwear assembly. For example, with the scrub cap example, an additional top panel would be used to cover the crown of the head H, with the present fabric panel 22 still serving the same function as is described herein. Additionally, the term fabric includes a wide variety of flexible or pliable sheet material made through weaving, knitting, spreading, felting, stitching, crocheting, bonding, etc. Thus, the unique aspect and advantages of the present headwear 20 can be achieved with a wide variety of headwear styles, made of various pliable sheets.

In one or more embodiments, the temple apertures 60 and 88 are slits parallel and located substantially on their respective first folds 40 and 68. The length of the right temple aperture 60 (or slit length) is less than or equal to the distance between the right upper joint 62 and right lower joint 64 (or pocket width). And, the length of the left temple aperture 88 (or slit length) is less than the distance between the left upper joint 90 and left lower joint 92 (or pocket width). In one or more embodiments, the slit length is less than 90% the pocket width, or the slit length is less than 80% the pocket width; or the slit length is less than 70% the pocket width, or the slit length is less than 60% the pocket width, or the slit length is less than 50% the pocket width.

In one or more embodiments, the lengths of the temple apertures 60 and 88 is greater than the distance between the respective upper joints 62 and 90 and the lower joints 64 and 92. In this case, the respective upper joints 62 and 90 and the lower joints 64 and 92 can intersect the temple apertures 60 and 88 to define a usable portion of the temple apertures 60 and 88. In one or more embodiments, the temple apertures 60 and 88 is configured to be positioned at the same height or above the height of the ear E scapha (i.e., at or near the region of the ear where glasses temples would normally rest). If the temple apertures 60 and 88 are configured to be positioned above the height of the ear E scapha, then the temples RT and LT would be substantially supported by the temple apertures 60 and 88 and minimally or not supported by the ears E for increased comfort, especially when wearing a helmet or the like over top the headwear 20.

The term "fabric" is used to describe the material comprising at least a portion of the present fabric panel 22. Fabrics comprise a wide variety of pliable sheet materials, including but not limited to manufactured textiles, such as woven, knitted, or felted material, or a similar material made of chemically bonded fibers (also non-woven fabric). In one or more embodiments, the percentage stretch of the fabric material (stretchability measured in just one direction or measured in more than one direction, and it elasticity or the ability to return to its original dimension after stretching) is less than or equal to 3%, or less than or equal to 5%, or less than or equal to 7%, or less than or equal to 10%, or less than or equal to 12%, or less than or equal to 15%, or less than or equal to 20%, or less than or equal to 25%, or less than or equal to 30%.

Aspects of the present specification may also be described as follows:

1. An article of headwear comprising a fabric panel having an inner surface and an outer surface opposite the inner surface, the inner surface configured to face a head of a user, a left ear portion of the fabric panel configured to be disposed at least partially over a left ear of the user, a left ear portion of the fabric panel configured to be disposed over a left ear of the user, and a forehead portion configured to be disposed over a forehead of the user; a left pocket formed by a left z-folded portion of the fabric panel between the left ear portion and the forehead portion forming a left three-layer arrangement, the left pocket having a left pocket opening configured to open towards the forehead portion, the left three-layer arrangement comprising a first left fold defining a left pocket bottom and a second left fold defining the left pocket opening, the left three-layer arrangement comprises a left first layer, a left second layer, and a left third layer, the left first layer configured to be positioned closest to the head when donned and forms a left pocket inner panel, the left second layer and the left third layer together form a left pocket outer panel; a left pocket formed by a left z-folded portion of the fabric panel between the left ear portion and the forehead portion forming a left three-layer arrangement, the left pocket having a left pocket opening configured to open towards the forehead portion, the left three-layer arrangement comprising a first left fold defining a left pocket bottom and a second left fold defining the left pocket opening, the left three-layer arrangement comprises a left first layer, a left second layer, and a left third layer, the left first layer configured to be positioned closest to the head when donned and forms a left pocket inner panel, the left second layer and the left third layer together form a left pocket outer panel; a left aperture formed through the fabric panel within the left pocket of the left z-folded folded portion; and a left aperture formed through the fabric panel within the left pocket of the left folded portion; wherein, when donned, the left pocket outer panel is configured to be at least partially spaced apart from the left pocket inner panel such that the left pocket opening is made sufficiently wide to permit insertion of a left temple of an item of eyewear, and the left pocket outer panel is configured to be at least partially spaced apart from the left pocket inner panel, when donned, such that the left pocket opening is made sufficiently wide to permit insertion of a left temple of the item of eyewear; and wherein, when donned, the left pocket opening and the left pocket opening are each configured to open in a substantially anterior direction, and the left pocket is configured to receive therein and the left aperture configured to receive therethrough the left temple of the item of eyewear, and the left pocket is configured to receive therein and the left aperture configured to receive therethrough the left temple of the item of eyewear.

2. The article of headwear of embodiment 1, wherein the left pocket is further defined by a left upper joint positioned above the left aperture and a left lower joint positioned below the left aperture, each fastening together the left three-layer construction, and the left pocket is further defined by a left upper joint positioned above the left aperture and a left lower joint positioned below the left aperture, each fastening together the left three-layer construction.

3. The article of headwear of embodiments 1 or 2, wherein the left upper joint, the left lower joint, the left upper joint, and the left lower joint are each a bar tack stitched transversely across the left three-layer arrangement and the left three-layer arrangement.

4. The article of headwear of any one of embodiments 1-3, wherein a left pocket interior is delineated by the left upper joint, the left lower joint, and the first left fold of the left three-layer construction, and a left pocket interior is delineated by the left upper joint, the left lower joint, and the first left fold of the left three-layer construction.

5. The article of headwear of any one of embodiments 1-4, wherein the left aperture is positioned through the first left fold and the left aperture is positioned through the first left fold.

6. An article of headwear comprising: a fabric panel having an inner surface and an outer surface opposite the inner surface, the inner surface configured to face a head of a user, a left ear portion of the fabric panel configured to be disposed at least partially over a left ear of the user, a left ear portion of the fabric panel configured to be disposed over a left ear of the user, and a forehead portion configured to be disposed over a forehead of the user; a left folded portion formed in the fabric panel between the left ear portion and the forehead portion, the left folded portion forming a left pocket having a left pocket opening configured to open towards the forehead portion; a left folded portion formed in the fabric panel between the left ear portion and the forehead portion, the left folded portion forming a left pocket having a left pocket opening configured to open towards the forehead portion; a left aperture formed through the fabric panel within the left pocket of the left folded portion; and a left aperture formed through the fabric panel within the left pocket of the left folded portion; wherein, when donned, the left pocket opening and the left pocket opening are each configured to open in a substantially anterior direction, and the left pocket is configured to receive therein and the left aperture configured to receive therethrough a left temple of an item of eyewear, and the left pocket is configured to receive therein and the left aperture configured to receive therethrough a left temple of the item of eyewear.

7. The article of headwear of embodiment 6, wherein the left folded portion and the left folded portion are each configured as a z-fold forming a left three-layer arrangement and a left three-layer arrangement, respectively, the left three-layer arrangement comprising a first left fold defining a left pocket bottom and a second left fold defining the left pocket opening, and the left three-layer arrangement comprising a first left fold defining a left pocket bottom and a second left fold defining the left pocket opening.

8. The article of headwear of embodiments 6 or 7, wherein the left pocket is further defined by a left upper joint positioned above the left aperture and a left lower joint positioned below the left aperture, each fastening together the left three-layer construction, and the left pocket is further defined by a left upper joint positioned above the left aperture and a left lower joint positioned below the left aperture, each fastening together the left three-layer construction.

9. The article of headwear of any one of embodiments 6-8, wherein the left upper joint, the left lower joint, the left upper joint, and the left lower joint are each a bar tack stitched transversely across each the left three-layer arrangement and the left three-layer arrangement respectively.

10. The article of headwear of any one of embodiments 6-9, wherein a left pocket interior is delineated by the left upper joint, the left lower joint, and the first left fold of the left three-layer construction, and a left pocket interior is delineated by the left upper joint, the left lower joint, and the first left fold of the left three-layer construction.

11. The article of headwear of any one of embodiments 6-10, wherein the left aperture is positioned through the first left fold and the left aperture is positioned through the first left fold.

12. The article of headwear of any one of embodiments 6-11, wherein the left three-layer arrangement comprises a left first layer, a left second layer, and a left third layer, the left first layer configured to be positioned closest to the head when donned and forms a left pocket inner panel, the left second layer and the left third layer together form a left pocket outer panel, and the left three-layer arrangement comprises a left first layer, a left second layer, and a left third layer, the left first layer configured to be positioned closest to the head when donned and forms a left pocket inner panel, the left second layer and the left third layer together form a left pocket outer panel.

13. The article of headwear of any one of embodiments 6-12, wherein the left pocket outer panel is configured to be at least partially spaced apart from the left pocket inner panel, when donned, such that the left pocket opening is made sufficiently wide to permit insertion of the left temple of the item of eyewear, and the left pocket outer panel is configured to be at least partially spaced apart from the left pocket inner panel, when donned, such that the left pocket opening is made sufficiently wide to permit insertion of the left temple of the item of eyewear.

14. A method of manufacturing an article of headwear comprising: providing a fabric panel having an inner surface and an outer surface opposite the inner surface, the inner surface configured to face a head of a user, a left ear portion of the fabric panel configured to be disposed at least partially over a left ear of the user, a left ear portion of the fabric panel configured to be disposed over a left ear of the user, and a forehead portion configured to be disposed over a forehead of the user; forming a left temple aperture through the fabric panel between the left ear portion and the forehead portion; forming a left temple aperture through the fabric panel between the left ear portion and the forehead portion; folding the fabric panel in a z-folded configuration to form a left pocket between the left ear portion and the forehead portion forming a left three-layer arrangement, with the left temple aperture positioned within the left pocket, the left pocket having a left pocket opening configured to open towards the forehead portion, the left three-layer arrangement comprising a first left fold defining a left pocket bottom and a second left fold defining the left pocket opening, the left three-layer arrangement comprises a left first layer, a left second layer, and a left third layer, the left first layer configured to be positioned closest to the head when donned and forms a left pocket inner panel, the left second layer and the left third layer together form a left pocket outer panel; fastening the left first layer, the left second layer, and the left third layer together to form a left upper joint positioned above the left temple aperture and a left lower joint positioned below the left temple aperture, the left upper joint and the left lower joint further defining the left pocket; folding the fabric panel in the z-folded configuration to form a left pocket between the left ear portion and the forehead portion forming a left three-layer arrangement, with the left temple aperture positioned within the left pocket, the left pocket having a left pocket opening configured to open towards the forehead portion, the left three-layer arrangement comprising a first left fold defining a left pocket bottom and a second left fold defining the left pocket opening, the left three-layer arrangement comprises a left first layer, a left second layer, and a left third layer, the left first layer configured to be positioned closest to the head when donned and forms a left pocket inner panel, the left second layer and the left third layer together form a left pocket outer panel; and fastening the left first layer, the left second layer, and the left third layer together to form a left upper joint positioned above the left temple aperture and a left lower joint positioned below the left temple aperture, the left upper joint and the left lower joint further defining the left pocket.

15. The method of embodiment 14, wherein the left temple aperture is positioned through the first left fold and the left temple aperture is positioned through the first left fold.

16. The method of embodiments 14 or 15, wherein the left upper joint, the left lower joint, the left upper joint, and the left lower joint are each a bar tack stitched transversely across each of the left three-layer arrangement and the left three-layer arrangement respectively.

17. The method of any one of embodiments 15-16, wherein, when donned, the left pocket outer panel is configured to be at least partially spaced apart from the left pocket inner panel such that the left pocket opening is made sufficiently wide to permit insertion of a left temple of an item of eyewear, and the left pocket outer panel is configured to be at least partially spaced apart from the left pocket inner panel, when donned, such that the left pocket opening is made sufficiently wide to permit insertion of a left temple of the item of eyewear.

18. The method of any one of embodiments 15-17, wherein, when donned, the left pocket opening and the left pocket opening are each configured to open in a substantially anterior direction, and the left pocket is configured to receive therein and the left aperture configured to receive therethrough a left temple of an item of eyewear, and the left pocket is configured to receive therein and the left aperture configured to receive therethrough a left temple of the item of eyewear.

In closing, it is to be understood that, although aspects of the present specification are highlighted by referring to specific embodiments, one skilled in the art will readily appreciate that these disclosed embodiments are only illustrative of the principles of the subject matter disclosed herein. The specific embodiments are not intended to be exhaustive or to limit the invention to the precise forms disclosed. Therefore, it should be understood that the disclosed subject matter is in no way limited to a particular compound, composition, article, apparatus, methodology, protocol, and/or reagent, etc., described herein, unless expressly stated as such. In addition, those of ordinary skill in the art will recognize that certain changes, modifications, permutations, alterations, additions, subtractions and sub-combinations thereof can be made in accordance with the teachings herein without departing from the spirit of the present specification. It is therefore intended that the scope of the invention is not to be limited by this detailed description. Furthermore, it is intended that the following appended claims and claims hereafter introduced are interpreted to include all such changes, modifications, permutations, alterations, additions, subtractions and sub-combinations as are within their true spirit and scope.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified, thus fulfilling the written description of all Markush groups used in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including," "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement and support for the phrases "consisting essentially of" and "consisting of."

All patents, patent publications, and other references cited and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard is or should be construed as an admission that the inventors are not entitled to antedate such disclosure by virtue of prior invention or for any other reason. All statements as to the date or representation as to the contents of these documents are based on the information available to the applicant and do not constitute any admission as to the correctness of the dates or contents of these documents.

Lastly, the terminology used herein is for the purpose of describing particular embodiments only and is not intended to limit the scope of the present invention, which is defined solely by the claims. Accordingly, the present invention is not limited to that precisely as shown and described.

What is claimed is:

1. An article of headwear comprising:

a fabric panel having an inner surface and an outer surface opposite the inner surface, the inner surface configured to face a head of a user, a right ear portion of the fabric panel configured to be disposed at least partially over a right ear of the user, a left ear portion of the fabric panel configured to be disposed over a left ear of the user, and a forehead portion configured to be disposed over a forehead of the user;

a right pocket formed by a right z-folded portion of the fabric panel between the right ear portion and the forehead portion forming a right three-layer arrangement, the right pocket having a right pocket opening configured to open towards the forehead portion, the right three-layer arrangement comprising a first right fold defining a right pocket bottom and a second right fold defining the right pocket opening, the right three-layer arrangement comprises a right first layer, a right second layer, and a right third layer, the right first layer configured to be positioned closest to the head when donned and forms a right pocket inner panel, the right second layer and the right third layer together form a right pocket outer panel;

a left pocket formed by a left z-folded portion of the fabric panel between the left ear portion and the forehead portion forming a left three-layer arrangement, the left pocket having a left pocket opening configured to open towards the forehead portion, the left three-layer arrangement comprising a first left fold defining a left pocket bottom and a second left fold defining the left pocket opening, the left three-layer arrangement comprises a left first layer, a left second layer, and a left third layer, the left first layer configured to be positioned closest to the head when donned and forms a left pocket inner panel, the left second layer and the left third layer together form a left pocket outer panel;

a right aperture formed through the fabric panel within the right pocket of the right z-folded folded portion; and a left aperture formed through the fabric panel within the left pocket of the left folded portion;

wherein, when donned, the right pocket outer panel is configured to be at least partially spaced apart from the right pocket inner panel such that the right pocket opening is configured to be sufficiently wide to permit insertion of a right temple of an item of eyewear, and the left pocket outer panel is configured to be at least partially spaced apart from the left pocket inner panel, when donned, such that the left pocket opening is configured to be sufficiently wide to permit insertion of a left temple of the item of eyewear;

and wherein, when donned, the right pocket opening and the left pocket opening are each configured to open in a substantially anterior direction, and the right pocket is configured to receive therein and the right aperture is configured to receive therethrough the right temple of the item of eyewear, and the left pocket is configured to receive therein and the left aperture is configured to receive therethrough the left temple of the item of eyewear.

2. The article of headwear of claim 1 wherein the right pocket is further defined by a right upper joint positioned above the right aperture and a right lower joint positioned below the right aperture, each fastening together the right three-layer construction, and the left pocket is further defined by a left upper joint positioned above the left aperture and a left lower joint positioned below the left aperture, each fastening together the left three-layer construction.

3. The article of headwear of claim 2 wherein the right upper joint, the right lower joint, the left upper joint, and the left lower joint are each a bar tack stitched transversely across the right three-layer arrangement and the left three-layer arrangement.

4. The article of headwear of claim 2 wherein a right pocket interior is delineated by the right upper joint, the right lower joint, and the first right fold of the left three-layer construction, and a left pocket interior is delineated by the left upper joint, the left lower joint, and the first left fold of the left three-layer construction.

5. The article of headwear of claim 1 wherein the right aperture is positioned through the first right fold and the left aperture is positioned through the first left fold.

6. An article of headwear comprising:

a fabric panel having an inner surface and an outer surface opposite the inner surface, the inner surface configured to face a head of a user, a left ear portion of the fabric panel configured to be disposed at least partially over a left ear of the user, a left ear portion of the fabric panel configured to be disposed over a left ear of the user, and a forehead portion configured to be disposed over a forehead of the user;

a right folded portion formed in the fabric panel between the right ear portion and the forehead portion, the right folded portion forming a right pocket having a right pocket opening configured to open towards the forehead portion;

a left folded portion formed in the fabric panel between the left ear portion and the forehead portion, the left folded portion forming a left pocket having a left pocket opening configured to open towards the forehead portion;

a right aperture formed through the fabric panel within the right pocket of the right folded portion; and a left aperture formed through the fabric panel within the left pocket of the left folded portion;

wherein, when donned, the right pocket opening and the left pocket opening are each configured to open in a substantially anterior direction, and the right pocket is configured to receive therein and the right aperture is configured to receive therethrough a right temple of an item of eyewear, and the left pocket is configured to receive therein and the left aperture is configured to receive therethrough a left temple of the item of eyewear, where the item of eyewear is configured to rest upon a nose of the user when the article of headwear is donned.

7. The article of headwear of claim 6 wherein the right folded portion and the left folded portion are each configured as a z-fold forming a right three-layer arrangement and a left three-layer arrangement, respectively, the right three-layer arrangement comprising a first right fold defining a right pocket bottom and a second left fold defining the right pocket opening, and the left three-layer arrangement comprising a first left fold defining a left pocket bottom and a second left fold defining the left pocket opening.

8. The article of headwear of claim 7 wherein the right pocket is further defined by a right upper joint positioned above the right aperture and a right lower joint positioned below the right aperture, each fastening together the right three-layer construction, and the left pocket is further defined by a left upper joint positioned above the left aperture and a left lower joint positioned below the left aperture, each fastening together the left three-layer construction.

9. The article of headwear of claim 8 wherein the le right ft upper joint, the right lower joint, the left upper joint, and the left lower joint are each a bar tack stitched transversely across each the right three-layer arrangement and the left three-layer arrangement respectively.

10. The article of headwear of claim 8 wherein a right pocket interior is delineated by the right upper joint, the right lower joint, and the first right fold of the right three-layer construction, and a left pocket interior is delineated by the left upper joint, the left lower joint, and the first left fold of the left three-layer construction.

11. The article of headwear of claim 7 wherein the right aperture is positioned through the first right fold and the left aperture is positioned through the first left fold.

12. The article of headwear of claim 6 wherein the right three-layer arrangement comprises a right first layer, a right second layer, and a right third layer, the right first layer configured to be positioned closest to the head when donned and forms a right pocket inner panel, the right second layer and the right third layer together form a right pocket outer panel, and the left three-layer arrangement comprises a left first layer, a left second layer, and a left third layer, the left first layer configured to be positioned closest to the head when donned and forms a left pocket inner panel, the left second layer and the left third layer together form a left pocket outer panel.

13. The article of headwear of claim 12 wherein the right pocket outer panel is configured to be at least partially spaced apart from the right pocket inner panel, when donned, such that the right pocket opening is configured to be sufficiently wide to permit insertion of the right temple of the item of eyewear, and the left pocket outer panel is configured to be at least partially spaced apart from the left pocket inner panel, when donned, such that the left pocket opening is configured to be sufficiently wide to permit insertion of the left temple of the item of eyewear.

14. A method of manufacturing an article of headwear comprising:

providing a fabric panel having an inner surface and an outer surface opposite the inner surface, the inner surface configured to face a head of a user, a right ear portion of the fabric panel configured to be disposed at least partially over a right ear of the user, a left ear portion of the fabric panel configured to be disposed over a left ear of the user, and a forehead portion configured to be disposed over a forehead of the user;

forming a right temple aperture through the fabric panel between the right ear portion and the forehead portion;

forming a left temple aperture through the fabric panel between the left ear portion and the forehead portion;

folding the fabric panel in a z-folded configuration to form a right pocket between the right ear portion and the forehead portion forming a right three-layer arrangement, with the right temple aperture positioned within the right pocket, the right pocket having a right pocket opening configured to open towards the forehead portion, the right three-layer arrangement comprising a first right fold defining a right pocket bottom and a second right fold defining the right pocket opening, the right three-layer arrangement comprises a right first layer, a right second layer, and a right third layer, the right first layer configured to be positioned closest to the head when donned and forms a right pocket inner panel, the right second layer and the right third layer together form a right pocket outer panel;

fastening the right first layer, the right second layer, and the right third layer together to form a right upper joint positioned above the right temple aperture and a right lower joint positioned below the right temple aperture, the right upper joint and the right lower joint further defining the right pocket;

folding the fabric panel in the z-folded configuration to form a left pocket between the left ear portion and the forehead portion forming a left three-layer arrangement, with the left temple aperture positioned within the left pocket, the left pocket having a left pocket opening configured to open towards the forehead portion, the left three-layer arrangement comprising a first left fold defining a left pocket bottom and a second left fold defining the left pocket opening, the left three-layer arrangement comprises a left first layer, a left second layer, and a left third layer, the left first layer configured to be positioned closest to the head when donned and forms a left pocket inner panel, the left second layer and the left third layer together form a left pocket outer panel; and fastening the left first layer, the left second layer, and the left third layer together to form a left upper joint positioned above the left temple aperture and a left lower joint positioned below the left temple aperture, the left upper joint and the left lower joint further defining the left pocket.

15. The method of claim 14, wherein the right temple aperture is positioned through the first right fold and the left temple aperture is positioned through the first left fold.

16. The method of claim 14, wherein the right upper joint, the right lower joint, the left upper joint, and the left lower joint are each a bar tack stitched transversely across each of the right three-layer arrangement and the left three-layer arrangement respectively.

17. The method of claim 14, wherein, when donned, the right pocket outer panel is configured to be at least partially spaced apart from the right pocket inner panel such that the right pocket opening is made sufficiently wide to permit insertion of a right temple of an item of eyewear, and the left pocket outer panel is configured to be at least partially spaced apart from the left pocket inner panel, when donned, such that the left pocket opening is made sufficiently wide to permit insertion of a left temple of the item of eyewear.

18. The method of claim 14, wherein, when donned, the right pocket opening and the left pocket opening are each configured to open in a substantially anterior direction, and the right pocket is configured to receive therein and the right aperture configured to receive therethrough a right temple of an item of eyewear, and the left pocket is configured to receive therein and the left aperture configured to receive therethrough a left temple of the item of eyewear.

* * * * *